United States Patent [19]

Boyko

[11] Patent Number: 4,775,178

[45] Date of Patent: Oct. 4, 1988

[54] FINAL CLOSING DEVICE FOR CLOSURE MEMBER ON A VEHICLE

[75] Inventor: James G. Boyko, Gorham, Me.

[73] Assignee: Maxaxam Corporation, Clinton, Mich.

[21] Appl. No.: 100,940

[22] Filed: Sep. 25, 1987

[51] Int. Cl.[4] ..... E05B 15/02

[52] U.S. Cl. ..... 292/341.16; 49/394; 49/449; 292/216

[58] Field of Search ..... 49/394, 449, 280, 300, 49/225; 292/201, 341.16, 216

[56] References Cited

U.S. PATENT DOCUMENTS

| | | | |
|---|---|---|---|
| 2,833,536 | 5/1958 | Joachim et al. | 49/280 X |
| 2,896,990 | 7/1959 | Garvey et al. | 292/201 X |
| 3,081,078 | 3/1963 | Lohr | 49/280 X |
| 3,622,188 | 11/1971 | Goeman | 49/394 X |
| 4,333,269 | 6/1982 | Bascou | 49/280 |
| 4,530,185 | 7/1985 | Moriya et al. | 49/394 X |
| 4,617,757 | 10/1986 | Kagiyama et al. | 49/280 |

*Primary Examiner*—Philip C. Kannan

*Attorney, Agent, or Firm*—Lerner, David, Littenberg, Krumholz and Mentlik

[57] ABSTRACT

A final closing device for a closure member on a vehicle is disclosed. The closure member, which may be swingably, slidably or otherwise mounted for movement between open and closed positions on a vehicle body member, includes a latch bolt movable between latched and unlatched positions and a handle or a lock member movable between open and closed positions. The final closing device includes a striker support plate mounted on the body member for rotational movement about an axis perpendicular to such plate, a striker carried by the striker support plate and projecting therefrom at position eccentrically offset from the axis, and means carried by the body member and connected to the striker support plate for rotating the striker support plate. The striker is movable between extended and retracted positions upon rotation of the striker support plate so that when the striker is engaged by the latch bolt and the striker support plate is rotated, the closure member is moved between a partially open position, away from the body member, and a fully closed position, in sealing engagement therewith.

8 Claims, 5 Drawing Sheets

FIG. 6
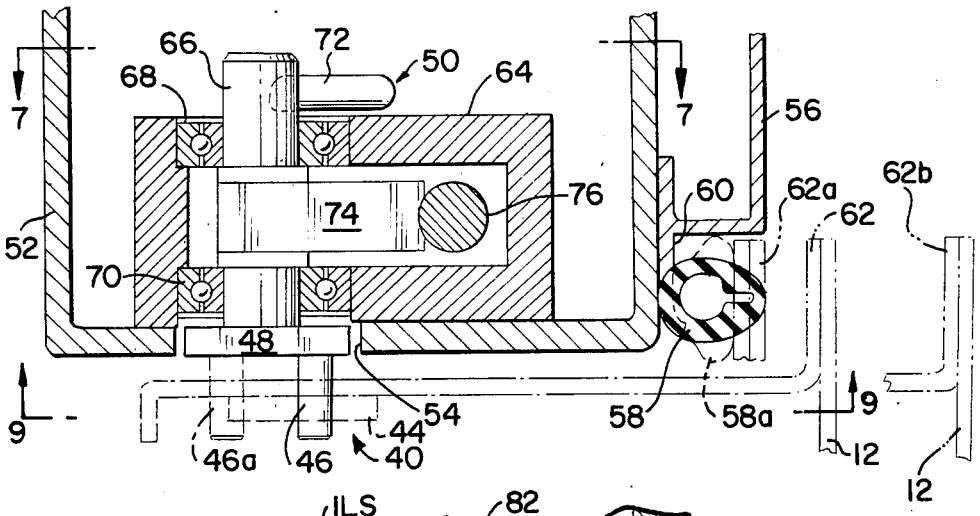
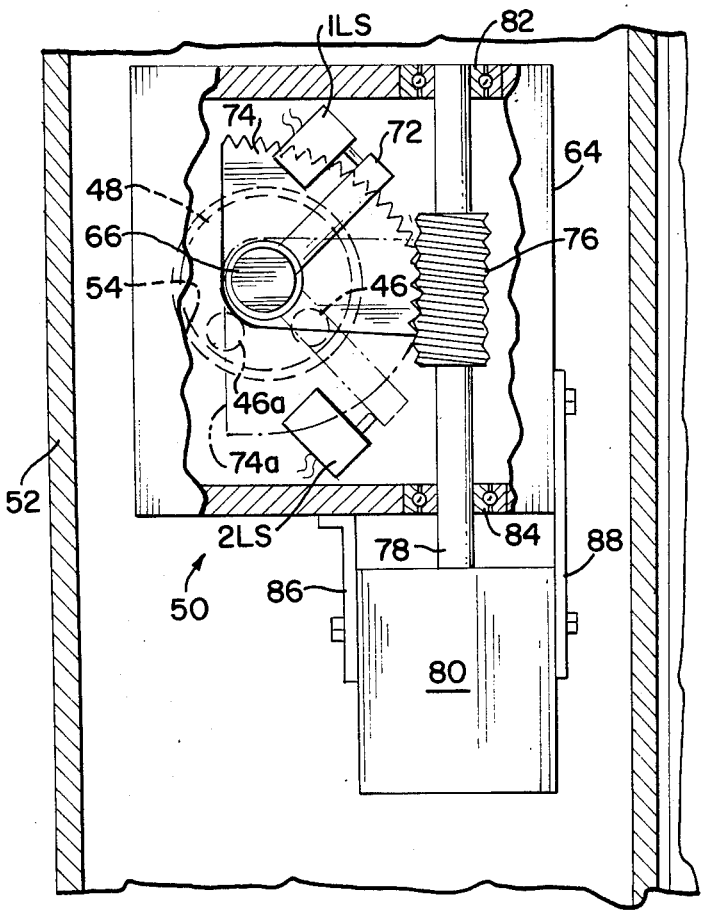
FIG. 7

FINAL CLOSING DEVICE FOR CLOSURE MEMBER ON A VEHICLE

BACKGROUND OF THE INVENTION

This invention relates to a final closing device for a closure member on a vehicle body and, more particularly, to a device for moving a vehicle-mounted closure member (e.g., a sliding door, a hinged door, a trunk lid, or the like) from a nearly closed position, at which a latch bolt engages a striker, to a fully closed position, at which the closure member is sealingly engaged with the vehicle body.

Vehicle closure members, whether hingedly connected to the vehicle body or slidingly mounted thereon, typically require only small forces to move them through the major extent of their opening and closing movement relative to the vehicle body. It is generally only during the final closing movement of the closure member, at which time the closure member must compress a weather seal strip carried by the vehicle body, that a large application of force must be applied to the closure member. However, in order to overcome the large resistance encountered in the final closing movement, vehicle closure members which are manually closed are typically moved with great momentum through their closing movement in order to insure that they will fully compress the weather seal strip at the end of such movement. Such high momentum movement of the closure members presents a significant safety problem with respect to vehicle occupants, who may inadvertently have failed to remove portions of their body from the path of movement of the closure member.

Various attempts have been made to mechanize the final closing movement of closure members. Such attempts have been made with respect to closure members that are manually moved through their initial, major range of movement (to the start of their final closing movement) and with respect to closure members which are automatically moved by powered devices through their initial major range of movement to that starting point. Examples of the former (manual preliminary movement) may be seen in U.S. Pat. Nos. 2,833,536, to Joachim et al and 2,896,990 to Garvey et al. Examples of the latter (powered preliminary movement) may be seen in U.S. Pat. Nos. 3,081,078 to Lohr, 4,333,269 to Bascou, and 4,530,185 to Moriya et al.

The final closing systems employed in the foregoing examples are generally costly, complicated mechanisms which are difficult to install and are subject to frequent breakdowns with attendant costly repairs. Moreover, it would be difficult, at best, to retrofit such mechanisms to vehicles not originally designed to receive them.

It is, therefore, a primary object of the present invention to provide an improved final closing device for closure members of vehicles.

Another object of the present invention is to provide an improved final closing device for closure members which is generally inexpensive, long lasting and capable of being retrofitted onto vehicles not originally designed to receive them.

A further object of the invention is to provide an improved final closing device for closure members on vehicles in which an eccentrically mounted, motor driven striker, carried on a vehicle body member, is employed to finally close the closure member with high force against the resistance of a weather seal strip carried by the vehicle body.

Additional objects and advantages of this invention will become apparent as the following description proceeds.

SUMMARY OF THE INVENTION

Briefly stated and in accordance with one embodiment of this invention, there is provided an improved final closing device for a closure member, which closure member is mounted for movement between open and closed positions on a vehicle body member and includes a latch bolt movable between latched and unlatched positions and a handle movable between open and closed positions. The final closing device comprises a striker support plate mounted on the vehicle body member for rotational movement about an axis perpendicular to the striker support plate; a striker carried by the striker support plate and projecting therefrom at a position eccentrically offset from the axis; and means carried by the vehicle body member and connected to the striker support plate for rotating the striker support plate. The striker is movable between extended and retracted positions upon rotation of the striker support plate so that when the striker is in latching engagement with the latch bolt and the striker support plate is rotated, the closure member is moved between a partially opened position, away from the vehicle body member, and a fully closed position, in sealing engagement therewith.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawings, in which:

FIG. 6 is a partly diagrammatic sectional view, taken along the line 6—6 of FIG. 5, showing internal details of the final closing device, and showing the relationship of the door edge to a weather seal strip on the vehicle body, under various conditions of closure of the door;

FIG. 7 is a sectional view, with parts cut away for clarity, taken along the line 7—7 of FIG. 6;

DETAILED DESCRIPTION

Figure 1:
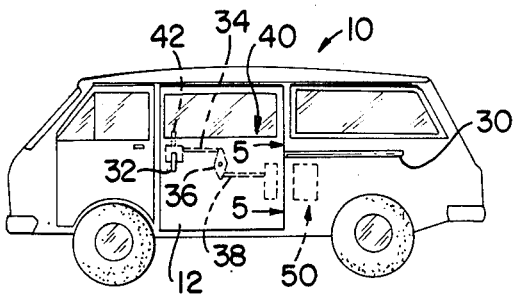
FIG. 1 is a diagrammatic, elevation view of a vehicle, in this case a van, in which the present invention is used to accomplish the final closing movement of a closure member comprising a sliding door.
Figure 2:
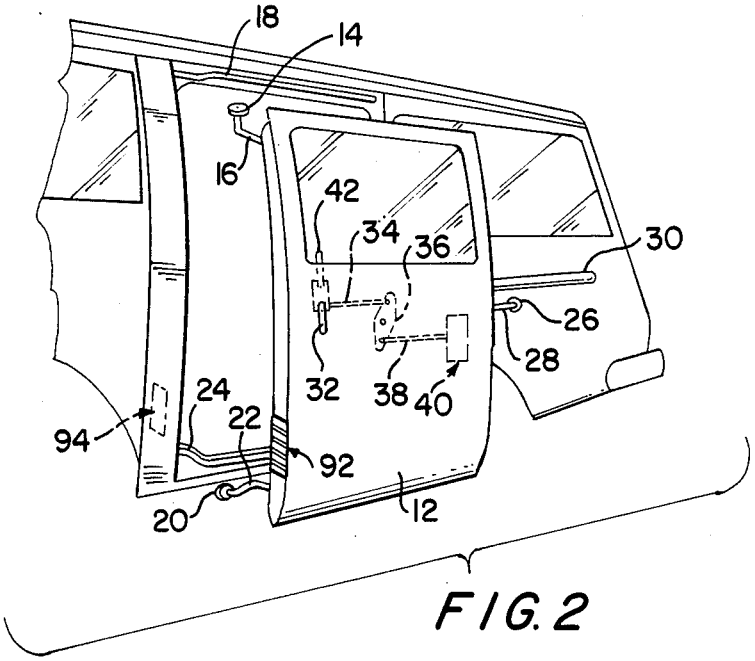
FIG. 2. is an enlarged, exploded view, with parts cut away for clarity, of the sliding door of FIG. 1, showing the manner in which the door is mounted for sliding movement relative to the vehicle body.

Referring to FIGS. 1 and 2, wherein the invention has been illustrated on a "van" type of vehicle 10 and is employed to accomplish the final closing movement of a closure member that in this instance comprises a sliding door 12, the arrangement of the sliding door 12 relative to the van 10 will first be briefly described.

The sliding door 12 is supported on the body of van 10 at three points. The first point of support comprises an upper roller 14 carried by an arm 16 that is fastened to the door 12. Roller 14 engages an upper guide rail 18 that is attached to the upper end of an open portion of the vehicle body that receives the door. The second point of attachment comprises a lower roller 20 carried by an arm 22 that is fastened to door 12. Roller 20 engages a lower guide rail 24 that is attached to the lower end of the open portion of the vehicle body. The third point of attachment comprise a mid-level roller 26 carried by an arm 28 that is fastened to the door 12 and engages a mid-level guide rail 30 attached to an outer body panel of the vehicle. The foregoing arrangement allows the slide door 12 to be slidably moved to and fro along the guide rails 18, 24 and 30.

The door 12 is provided with conventional inner (not shown) and outer handles 32 which are connected via a linkage arrangement including arm 34, cross link 36 and arm 38 to a conventional latch mechanism, shown generally at 40. A suitable internal locking arrangement, shown generally at 42 and an external key locking arrangement (not shown) are provided to prevent unauthorized entry into the vehicle.

Figure 5:
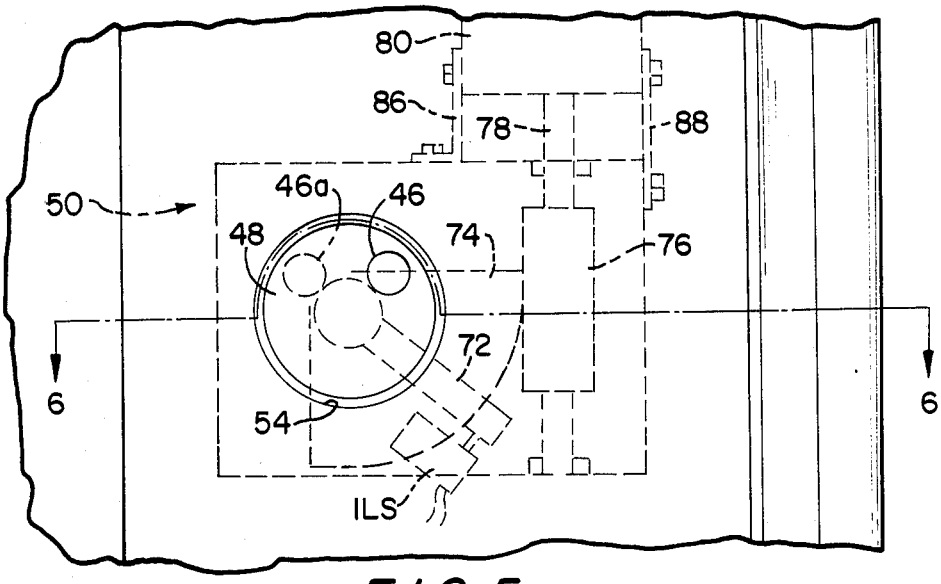
FIG. 5 is an elevation view, taken along the line 5—5 of FIG. 1, showing the striker and striker plate of the final closing device.
Figure 9:
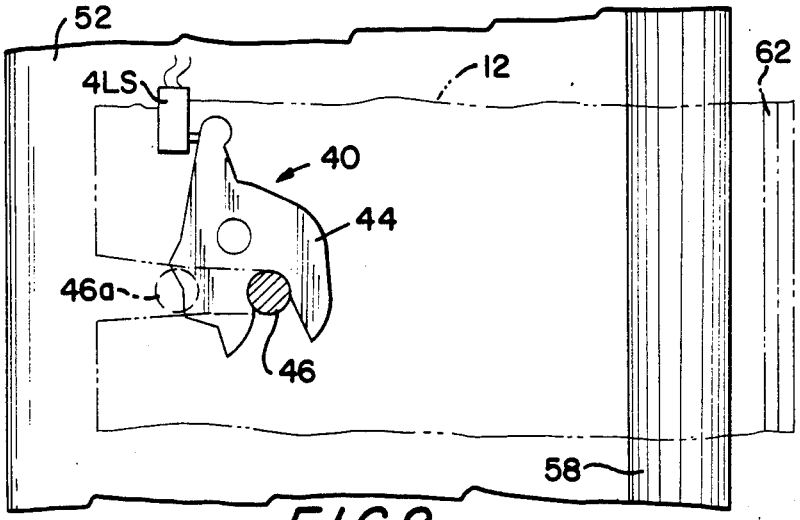

Referring to FIGS. 5, 6 and 9 in conjunction with FIG. 1, the door 12 is illustrated therein in its partially open position, ready for final closing. Latch mechanism 40 includes a latch bolt 44 which is at this time fully engaged with and latched on to a striker or striker pin 46 that is carried by and projects outwardly from a rotatable striker plate 48. The striker 46 and striker plate 48 form parts of a final closing device, shown generally at 50. Device 50 is fixedly mounted upon a body member 52 of vehicle 10 with its rotatable striker plate 48 positioned within an aperture 54 in body member 52 so that striker 46 is positioned in the path of movement of the latch member 44 on door 12.

Figure 10:
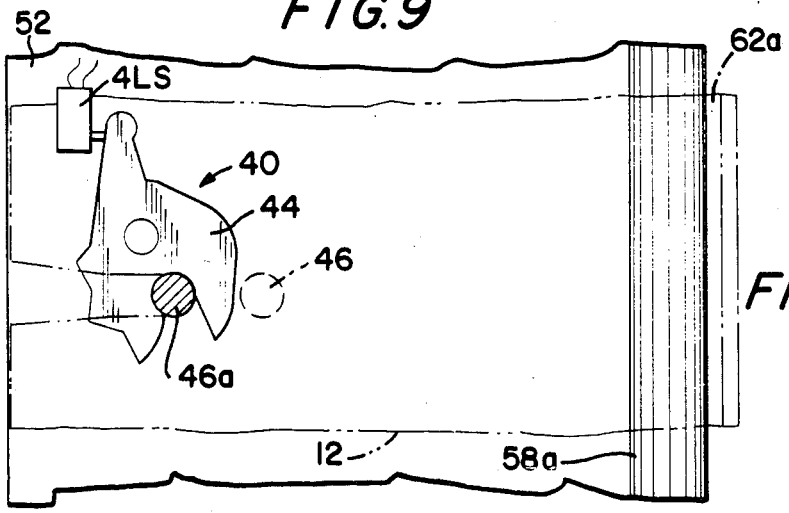

The body member 52 forms part of the frame of the opening for the door 12 and has fastened to it a panel member 56 which carries an elastomeric weather seal strip 58 on a flange 60 formed thereon. The weather seal strip 58 is adapted to be compressed by a marginal portion 62 of the door 12 when the door is finally closed. The marginal portion 62 of door 12 has been illustrated at 62*a* in FIGS. 6 and 10 to show the door in its finally closed position with the seal strip 58 compressed. The compressed condition of seal strip 58 has been illustrated by broken lines at 58*a* in FIG. 6. As illustrated at 62 in FIGS. 6 and 9, the door 12 is in its partially closed position, with the latch member 44 engaged and latched to the striker 46, and with the striker 46 at its extended position. The retracted position of striker 46 has been shown in broken lines at 46*a* in FIG. 6. The marginal portion 62 of door 12 is also shown in FIG. 6, in broken lines at 62*b*, to represent the position the marginal portion of the door would be in just prior to the engagement of latch 44 with striker 46. This condition of the door 12 and its marginal portion 62*b* has also been illustrated in FIG. 8.

Referring to FIGS. 5, 6 and 7, the final closing device 50 will now be considered in greater detail. Final closing device 50 includes a housing 64 which is bolted or otherwise fastened to body member 52. Housing 64 rotatably supports a shaft 66 in bearings 68, 70 carried by the housing. Shaft 66 has fixed to one of its ends striker plate 48 and carries an actuating arm 72 at the other of its ends so that when shaft 66 rotates, striker plate 48 and actuating arm 72 rotate along with it. Shaft 66 has a sector gear 74 keyed thereto. The sector gear is driven by a worm gear 76 carried on the shaft 78 of a motor 80. Shaft 78 is supported in housing 64 by bearings 82, 84, and the motor 80 is fastened by brackets 86, 88 to housing 64.

It will thus be seen that when motor 80 is actuated to rotate sector gear 74 from the position shown in solid lines in FIG. 7 to the position shown in broken lines at 74*a* therein, shaft 66 is correspondingly rotated, carrying striker pin 46 from its solid line position shown at 46 in FIGS. 5 and 6 to its broken line position shown at 46*a* in those figures. This, in turn, moves the marginal portion 62 of door 12 from its position shown at 62 in FIGS. 6 and 9 to its position shown at 62*a* in FIGS. 6 and 10.

The extended and retracted positions of striker 46 are sensed by corresponding limit switches 1LS and 2LS, shown in FIG. 7. Limit switch 1LS includes a pair of normally closed contacts therein which are opened and held open by actuating arm 72 when the arm actuates limit switch 1LS, signifying that striker 46 has reached and is at its extended position. When striker 46 is moved to its retracted position, actuating arm 72 is moved away from limit switch 1LS and into actuating contact with limit switch 2LS. Limit switch 2LS includes a normally closed contact therein which is opened and held open by actuating arm 72 when the striker 46 reaches and is at its fully retracted position, at which position the door 12 is in its finally closed position compressing seal strip 58.

Figure 3:
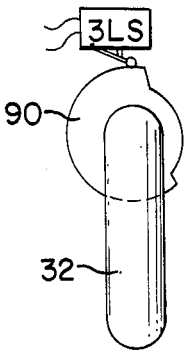
FIGS. 3 and 4 are enlarged, isolated views of a door handle and an associated limit switch employed in conjunction therewith, showing the door handle in its closed and opened positions, respectively.
Figure 4:
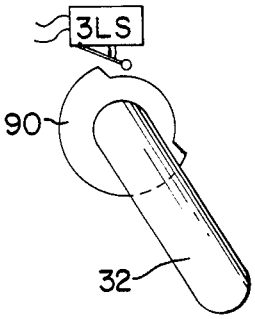

Referring to FIGS. 3, 4, 8 and 9, the limit switches associated with door handle 32 and latch bolt 44 will now be considered. As shown in FIGS. 3 and 4, door handle 32 may be manually rotated between a closed position (FIG. 3) and an open position (FIG. 4). The door handle 32 has a cam 90 fixed thereto which rotates along with the door handle when it is moved between its open and closed positions. Cam 90 actuates a limit switch 3LS when it is in its closed position and deactuates the limit switch 3LS when it is in its open position. Limit switch 3LS is provided with two sets of contacts one of which is normally closed and the other of which is normally open. Both sets of contacts change condition when the limit switch is actuated upon the closing of the door handle.

Figure 8:
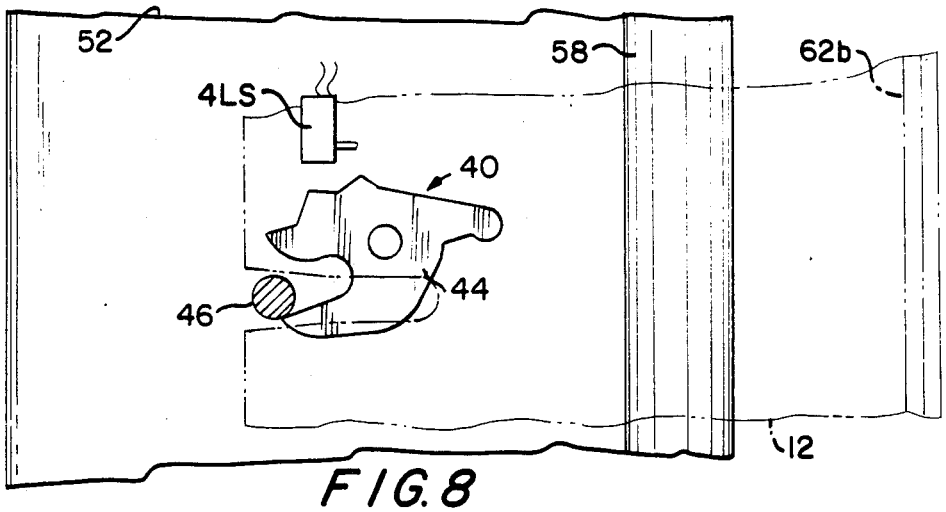
FIGS. 8—10 are diagrammatic elevation views, taken along the line 9—9 of FIG. 6, showing the relationship of the latch bolt and striker to the weather seal strip on the vehicle body, during various stages of closing of the sliding door; and, FIG. 11 is a circuit diagram of an electrical circuit that may be employed in controlling the operation of the final closing device.

Latch bolt 44, which moves between its unlatched or open position, shown in FIG. 8, and its latched or closed position, shown in FIG. 9, actuates the contacts of a limit switch 4LS when it arrives at its latched position. Limit switch 4LS is provided with a set of normally open contacts which close when the latch bolt moves to its latched position, shown in FIG. 9, engaging and latching on to striker 46. These contacts open when latch bolt 44 is moved to its unlatched position, shown in FIG. 8. Latch bolt 44 is moved to its unlatched position when the door handle 32 is moved from its closed to its open position. This is accomplished by the linkage assembly, shown in FIG. 1, comprising arm 34, cross link 36 and arm 38, which connects to the latch mechanism 40 in a conventional manner. The door handle 32 can, of course, be replaced by a key lock or other actuating mechanism (not shown) when the final closing device 50 is used in conjunction with another type of closure member (e.g. a trunk lid or a hingedly mounted door), rather than a sliding door.

Referring to FIG. 2, a plurality of spring-loaded movable contacts, shown generally at 92, are disposed on the front end surface of sliding door 12 and a plurality of corresponding fixed contacts, shown generally at 94, are disposed on the front end surface of the body opening for door 12. Contacts 92 and 94 interconnect the limit switches 3LS and 4LS mounted on door 12 with the remainder of the electrical circuits which control final closing device 50. These contacts are closed when door 12 is being manually closed and nears the position at which the latch bolt 44 latches onto striker 46 and the final closing device 50 actuates to finally close the door. Contacts 92 and 94 remain closed during the time that door 12 is fully closed, and during the initial opening movement of door 12.

Figure 11:
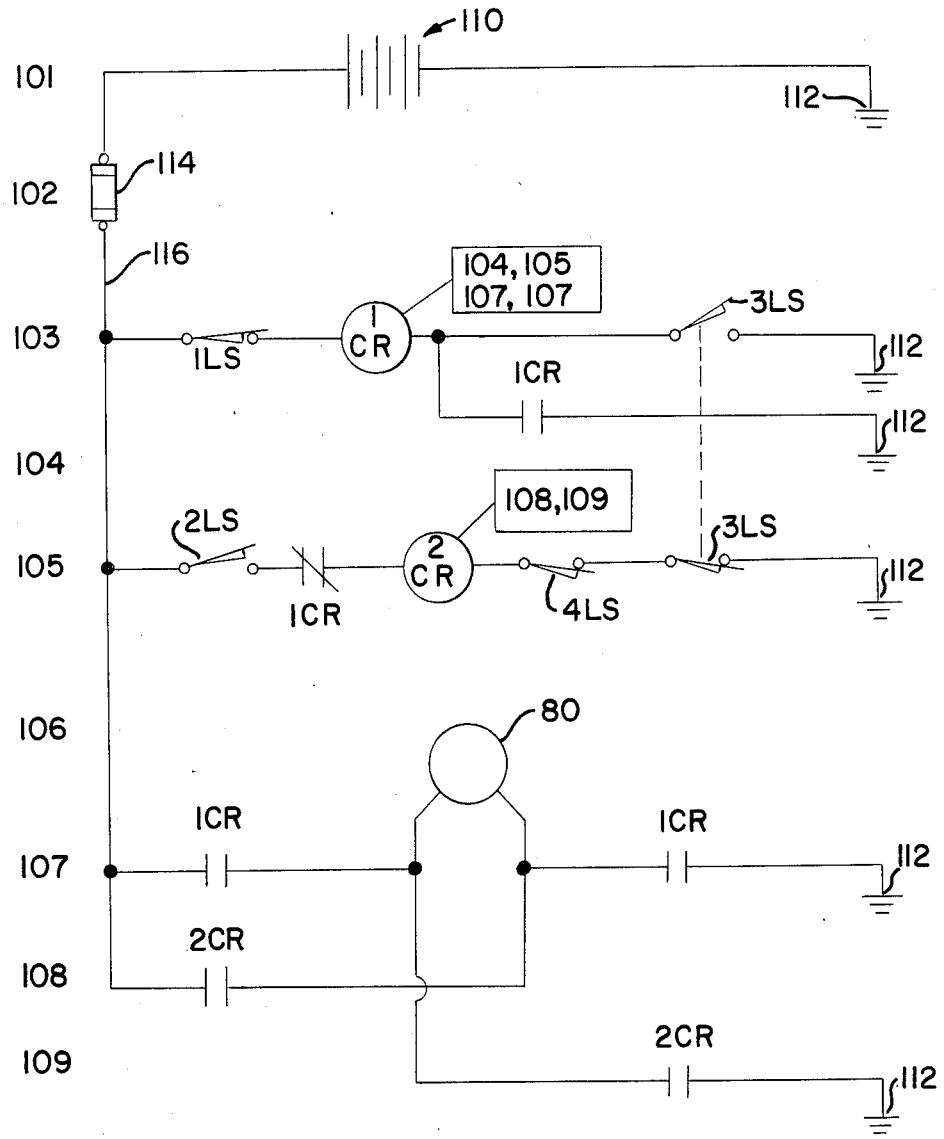

Referring now to FIG. 11, which comprises a circuit diagram of an electrical system that may be employed in controlling the final closing device 50, a line numbering system has been employed to facilitate the description of the electrical system. The line numbers have been listed on the left side of FIG. 11 and they run consecutively from line number 101 through line number 109. The line numbers on which the contacts of relays appear have been listed above and to the right of the relays they refer to. Thus, referrring to FIG. 11, relay 1CR (line 103) is provided with single sets of relay contacts positioned in lines 104 and 105 and with two sets of relay contacts positioned in line 107 (as indicated by these numbers being placed above and to the right of control relay 1CR). Similarly, control relay 2CR (line 105) is provided with single sets of relay contacts in lines 108 and 109 (as indicated by these numbers being placed above and to the right of control relay 2CR).

The electrical control system for final closing device 50 includes a battery, shown generally at 110, one terminal of which is connected to ground at 112 and the other terminal of which is connected through a fuse 114 to a conductor 116 which feeds power to the various components of the electrical control system. The components of the electrical control system have been illustrated in FIG. 11 in the conditions they assume when the sliding door 12 is in its fully closed condition. Thus, the normally closed contacts of limit switch 1LS in line 103 are closed (signifying that striker 46 is in a position other than its extended position); the normally closed contacts of limit switch 2LS in line 105 are open (signifying that striker 46 is fully retracted); the normally closed contacts of limit switch 3LS in line 103 are open (signifying that the door handle 32 is closed); the normally open contacts of limit switch 3LS in line 105 are closed (also signifying that the door handle 32 is closed; and, the normally open contacts of limit switch 4LS in line 105 are closed (signifying that the latch bolt 44 is in its latched position in engagement with striker 46).

When the door handle 32 (FIG. 4) is opened, limit switch 3LS deactuates and its contacts in line 103 close and its contacts in line 105 open. Accordingly, control relay 1CR energizes, closing its contacts in lines 104 and 107 and opening its contacts in line 105. When contacts 1CR in line 104 close, they bypass the contacts of the door handle limit switch 3LS in line 103 and retain relay 1CR energized until contacts 1LS in line 103 are subsequently opened by the arrival of striker 46 at its extended position. The aforementioned closing of contacts 1CR in line 107 energizes motor 80 to rotate in a direction that moves striker 46 from its retracted position to its extended position. Also, when the door handle 32 was opened to the position shown in FIG. 4, as mentioned above, latch bolt 44 became disengaged from striker 46 and assumed the position shown in FIG. 8, deactuating limit switch 4LS. Thus, normally open contact 4LS in line 105 is now open, preventing control relay 2CR from energizing until the latch is again closed.

When the striker 46 has been rotated by motor 80 to the extended position shown in full lines in FIGS. 5 and 6, actuating arm 72 actuates limit switch 2LS, causing contacts 2LS in line 105 to close and preconditioning relay 2CR for subsequent energization. Also, when the handle 32 is released after door 12 is opened, it returns to its closed position, shown in FIG. 3, and limit switch 3LS is actuated to return the normally open contact 3LS in line 105 to a closed condition and the normally closed contacts in line 103 to an open condition. Thus, control relays 1CR (line 103) and 2CR (line 105) are both de-energized at this point, and the door 12 is in a fully open position. When the door 12 is partially closed to the position shown in FIG. 9, so that the latch bolt 44 moves to its latched position in engagement with striker 46, limit switch 4LS actuates and its contacts in line 105 close, energizing control relay 2CR in line 105.

Accordingly, contacts 2CR in lines 108 and 109 close, energizing motor 80 for rotation in a direction opposite to that of its previous rotation and causing striker 46 to be rotated from its extended position 46, shown in solid lines in FIGS. 5 and 6, to its retracted position **46*a*, shown in broken lines in FIGS. 5 and 6. As a result, door 12 is moved from its partially open position to its finally closed position, at which the marginal portion 62 compresses the seal 58, as shown at 62*a* and 58*a* in FIGS. 6 and 10. With the arrival of striker 46 at its retracted position, limit switch 2LS (FIG. 7) is actuated and its contacts in line 105 open, de-energizing control relay 2CR in line 105. Contacts 2CR in lines 108 and 109 thus open, de-energizing motor 80 and returning the electrical control circuits of FIG. 11 to the condition shown in that figure. The electrical control system is thus awaiting subsequent opening of the door handle 32** to initiate another operating cycle of the system.

From the foregoing description, it can be seen that the present invention provides an improved final closing device for vehicle closure members, in which device an eccentrically mounted, motor driven striker, carried on the vehicle body member is employed to finally close the closure member with high force against the resistance of the weather seal strip carried by the vehicle body. The resulting final closing device is economical, sturdy in construction, reliable in operation, and can be retrofitted onto vehicles that were not originally designed to receive such a device.

While there has been shown and described what is presently considered to be the preferred embodiment of this invention, it will be obvious to those skilled in the art that various changes and modifications may be made without departing from the broader aspects of this invention. It is, therefore, aimed in the appended claims to cover all such changes and modifications as fall within the true spirit and scope of this invention.

What is claimed is:

1. A final closing device for a closure member, which closure member is mounted for movement between open and closed positions on a vehicle body member and includes a latch bolt movable between latched and unlatched positions and a handle movable between open and closed positions, said device comprising a striker support plate mounted on said body member for rotational movement about an axis perpendicular to said plate, a striker carried by said striker support plate and projecting therefrom at a position eccentrically offset from said axis, and means carried by said body member and connected to said striker support plate for rotating said striker support plate, said striker being movable between extended and retracted positions upon rotation of said striker support plate so that when said striker is in latching engagement with said latch bolt and said striker support plate is rotated, said closure member is moved between a partially open position, away from said body member, and a fully closed position, in sealing engagement therewith.

2. A final closing device according to claim 1 and further including a housing for attaching said device to said vehicle body member, said striker support plate rotating means comprising a shaft member rotatably mounted in said housing, said shaft member being coaxial with said axis and carrying said striker support plate at one end therereof, a driven gear member mounted upon said shaft member and keyed thereto within said housing, a driving gear member rotatably supported within said housing and coupled to said driven gear member, and a motor supported by said housing and drivingly connected to said driving gear member.

3. A final closing device according to any one of claims 1 or 2, and further including circuit means connected to said striker support plate rotating means for controlling operation of said device, said circuit means including switch means responsive to said latch bolt being in its latched position and said striker being in its extended position for actuating said striker support plate rotating means to move said striker to its retracted position.

4. A final closing device according to claim 3, wherein said switch means is further responsive to said striker arriving at its retracted position for deactuating said striker support plate rotating means when said striker reaches said retracted position.

5. A final closing device according to claim 3, wherein said switch means is further responsive to the position of said handle and actuates said striker support plate rotating means to move said striker to its extended position when said handle is moved to its open position while said striker is in a position that is other than its extended position.

6. A final closing device according to claim 5, wherein said switch means deactuates said rotating means when said striker reaches its extended position.

7. A final closing device according to claim 3, wherein said switch means is further responsive to said handle being in its closed position before actuating said striker plate rotating means to move said striker to its retracted position.

8. A final closing device according to claim 7, wherein said switch means is further responsive to said striker arriving at its retracted position for deactuating said striker support plate rotating means when said striker reaches said retracted position.

* * * * *